United States Patent [19]

Martial

[11] Patent Number: 4,596,084

[45] Date of Patent: Jun. 24, 1986

[54] RECEIVER FOR HUNTING GUNS

[75] Inventor: Jean P. Martial, Haccourt, Belgium

[73] Assignee: Fabrique Nationale Herstal, Herstal, Belgium

[21] Appl. No.: 761,308

[22] Filed: Jun. 30, 1985

Related U.S. Application Data

[62] Division of Ser. No. 556,608, Nov. 30, 1983, abandoned.

[30] Foreign Application Priority Data

Jan. 24, 1983 [BE] Belgium ..... 2/60005

[51] Int. Cl.[4] ..... F41C 11/00

[52] U.S. Cl. ..... 42/75 C

[58] Field of Search ..... 42/75 C

[56] References Cited

U.S. PATENT DOCUMENTS

| | | | |
|---|---|---|---|
| 2,050,038 | 8/1936 | Browning | 42/75 C |
| 2,455,644 | 12/1948 | Barnes | 42/75 C |
| 3,942,277 | 3/1976 | Atchisson | 42/25 |
| 4,012,859 | 3/1977 | Johansson et al. | 42/75 C |

*Primary Examiner*—Charles T. Jordan
*Assistant Examiner*—Ted L. Parr
*Attorney, Agent, or Firm*—Bacon & Thomas

[57] ABSTRACT

Receiver for a hunting gun, characterized in that it consists of the assembly of two shells the outer faces of which are smooth, their inner faces being each previously provided with a profiled reinforcing sheet which is also stamped, the profiles of the said sheets being additionally used for supporting and guiding the conventional parts provided inside the receiver.

4 Claims, 4 Drawing Figures

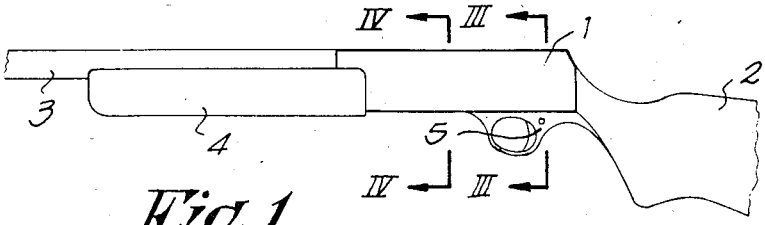
Fig. 1
Fig. 2
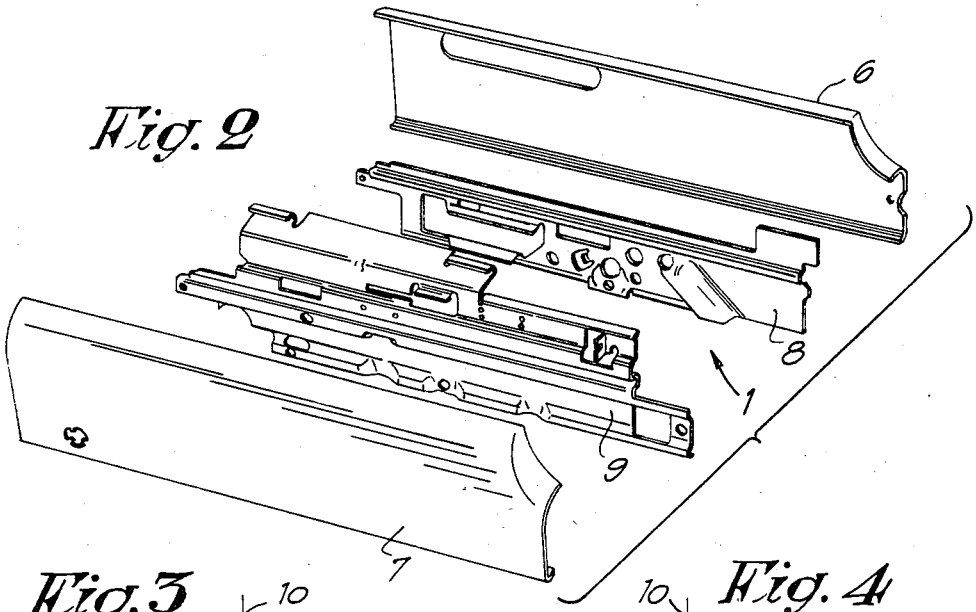
Fig. 3
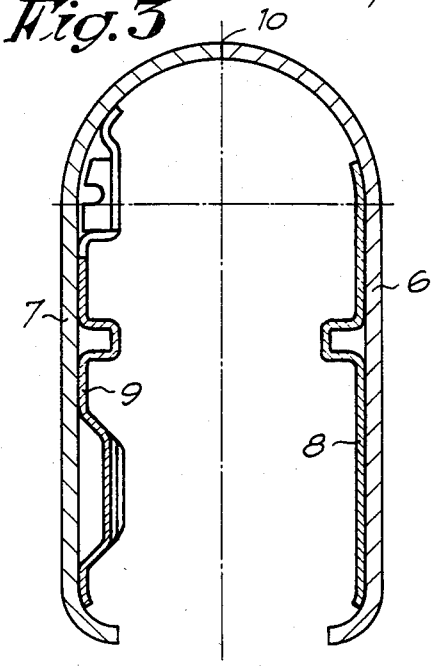
Fig. 4
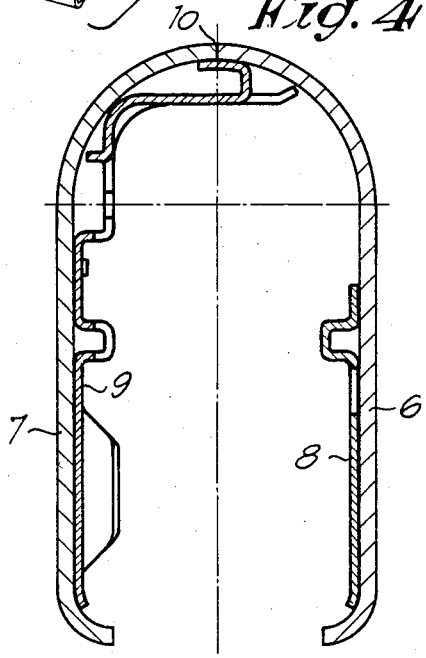

RECEIVER FOR HUNTING GUNS

This application is a division of application Ser. No. 556,608, filed Nov. 30, 1983, abandoned.

The present invention relates to a receiver for a hunting gun.

Heretofore, the receivers for hunting guns have been machined out of the mass, which is particularly expensive. On the contrary, in the case of war weapons, receivers have already been made of stamped sheet. However, the appearance of such parts is not compatible with the aesthetical requirements of the major part of the sport shooters and the hunters.

The purpose of the present invention is to allow a stamping manufacture which does not present the drawback of the known techniques, while giving a perfectly rigid receiver in spite of an external appearance which is completely comparable with that of the conventional receivers.

According to the invention, this object is reached through the assembly of two shells the outer faces of which are smooth, whereas the inner faces are each previously provided with a profiled reinforcing sheet which is also stamped, the profiles of the said sheets being additionally used for supporting and guiding the conventional parts provided inside the receiver.

An embodiment of the invention is described hereafter by way of illustration and without any limitation, reference being made to the enclosed drawings in which:

FIG. 1 is a fragmentary diagrammatic view of an automatic hunting gun;

FIG. 2 is an exploded view of a receiver of the gun shown in FIG. 1; and FIGS. 3 and 4 are sections respectively taken on the lines III—III and IV—IV of FIG. 1.

The FIG. 1 shows the receiver 1 extending the butt 2, the barrel 3, the hand shield 4 and the trigger-guard 5.

The receiver 1 consists of two shells 6 and 7 made of stamped sheet, the outer and inner faces thereof being smooth.

The inner faces of the said shells are made integral with profiled reinforcing sheets 8 and 9 respectively e.g. by welding or other suitable means of attachment known in the art, then both shells are assembled e.g. by electron beam welding the upper edges thereof as shown in 10.

The sheets 8 and 9 are profiled to form the supporting and guiding surfaces required for the parts provided inside the receiver, such as the moving breech, the stops, etc.

The above described construction method results into a rigid and light receiver the aesthetical appearance of which is substantially identical to that of the conventional receiver. Relative to the latter, the manufacturing times are substantially reduced, thereby reducing also the cost.

It is apparent that numerous modifications may be brought to the above described example as a function of the intended weapon type, the cocking and ejection mechanism thereof, etc.

I claim:

1. A method of making a receiver for a hunting gun comprising the steps of:

(a) forming a first half of an outer receiver shell from sheet metal by a stamping operation such that the first receiver half has a smooth outer surface and a curved upper portion defining a first longitudinal edge;

(b) forming a second half, complimentary to the first half, of the outer receiver shell from sheet metal by a stamping operation such that the second receiver half has a smooth outer surface and a curved upper portion defining a second longitudinal edge;

(c) forming a first inner reinforcing member from sheet metal by a stamping operation such that the first reinforcing member has means for supporting and guiding movable parts of the gun formed thereon;

(d) forming a second inner reinforcing member from sheet metal by a stamping operation such that the second inner reinforcing member has means for supporting and guiding movable parts of the gun formed thereon;

(e) attaching the first inner reinforcing member to an interior surface of the first half of the outer shell;

(f) attaching the second inner reinforcing member to an interior surface of the second half of the outer shell; and (g) attaching the first half of the outer receiver shell to the second half of the outer receiver shell along their first and second longitudinal edges.

2. The method according to claim 1 wherein the first and second inner reinforcing sheets are attached to the first and second halves of the outer receiver shell by welding.

3. The method according to claim 2 wherein the first and second halves of the outer receiver shell are attached together by welding.

4. The method according to claim 3 wherein the first and second halves of the outer receiver shell are attached together by electron beam welding.

* * * * *